US005228730A

United States Patent [19]

Gokcebay et al.

[11] Patent Number: 5,228,730

[45] Date of Patent: Jul. 20, 1993

[54] APPARATUS FOR CONVERTING MECHANICAL LOCKS TO OPERATE ELECTRICALLY USING MOMENTARY POWER

[75] Inventors: Asil T. Gokcebay, San Francisco; Mustafa Gunan, Orinda, both of Calif.

[73] Assignee: Security People, Inc., San Francisco, Calif.

[21] Appl. No.: 939,729

[22] Filed: Sep. 2, 1992

[51] Int. Cl.[5] ..... E05C 1/16

[52] U.S. Cl. ..... 292/144; 292/DIG. 62; 292/150; 292/359

[58] Field of Search ..... 292/144, 150, 359, 341.16, 292/DIG. 62

[56] References Cited

U.S. PATENT DOCUMENTS

| | | | |
|---|---|---|---|
| 3,792,888 | 2/1974 | Kambic | 292/173 |
| 3,894,417 | 7/1975 | Taniyama | 70/156 |
| 4,053,939 | 10/1977 | Nakauchi | 361/171 |
| 4,099,752 | 7/1978 | Geringer | 292/144 |
| 4,355,830 | 10/1982 | Rau, III | 292/144 |
| 4,529,234 | 7/1985 | Senften | 292/150 X |
| 4,656,850 | 4/1987 | Tabata | 70/276 |
| 4,726,613 | 2/1988 | Foshee | 292/150 X |
| 4,784,415 | 11/1988 | Maloval | 292/150 X |
| 4,978,155 | 12/1990 | Kobayashi | 292/336.3 |

*Primary Examiner*—Richard E. Moore
*Attorney, Agent, or Firm*—Thomas M. Freiburger

[57] ABSTRACT

A conversion apparatus has a magnetic latching solenoid equipped with a special plunger shaft and piston mechanism which can move independently of the plunger, allowing mechanical locks to operate with momentary battery power. The plunger shaft is bored to accept the piston which consists of an inner shaft and a locking pin. The locking pin and inner shaft are secured to the plunger shaft with a light spring. With this mechanism, the operation of locking and unlocking is complete, regardless of readiness of the locking device, since the locking pin will move to the intended position of locking/unlocking after momentary prevention such as premature twisting of the lock knob.

10 Claims, 7 Drawing Sheets

APPARATUS FOR CONVERTING MECHANICAL LOCKS TO OPERATE ELECTRICALLY USING MOMENTARY POWER

BACKGROUND OF THE INVENTION

This invention relates to locking and unlocking of a mechanical lock device by use of momentary electrical power.

Locks operated by use of electricity are widely known and used today. Virtually every mechanical lock manufacturer offers a model which is electrically operated. The operation of these locks is divided into two categories: 1) fail-safe, and 2) fail-secure.

Both of these systems (fail-safe and fail-secure) commonly utilize a push or pull type solenoid to achieve the locking and unlocking, and require to be powered or unpowered for a set amount of time or until the door is opened (if being monitored).

In fail-safe locks, the lock is locked by continuous power and is opened by interruption of the power. These systems are used in emergency exit doors where in the case of power failure or other types of emergencies, the lock unit will automatically be unlocked. Since the operation of this unit requires continuous power to stay locked, they are powered by the building's electricity (wired) and are not suitable for battery operation.

In fail-secure locks, which are more commonly used in access control systems, the lock is normally locked until powered. Theoretically, this type of lock unit can be operated by either the building's electricity or by battery power since it requires only momentary power for operation. However, battery operation becomes unsuitable for this operation as well, due to the problem described below.

The common problem associated with the locking and unlocking of the lock device is that, in anticipation of entering, the person seeking access tries to push or turn the lock's lever or knob mechanism during or prior to the unit being powered, thus causing the locking pin of the solenoid to jam. Only when the lever or knob mechanism is released by the person seeking access, is the solenoid able to pull or push the locking pin for its operation. Due to this, an extensive period of powering of the solenoid is required in order to complete the operation. This becomes unsuitable for lock units that rely on a battery for power, because it requires frequent replacement of the batteries.

Magnetic latching solenoids that operate using momentary power have existed for some time. These solenoids require a very short pulse of power to change position, and they stay in their new position until powered again in the reverse polarity.

However, magnetic latching solenoids are not suitable. This is because if the person seeking access is placing pressure on the lock's knob or lever during the period of powering of the solenoid, the solenoid will not be able to perform its function. Or if the person seeking access continues to hold the knob or lever of the lock mechanism in a turned position after the unlocking of the lock, during which the solenoid is being powered for locking the lock mechanism, then the locking pin of the solenoid will be unable to enter into the locking hub. Therefore, again the solenoid will not be able to perform its function, making this type of solenoid unsuitable.

In U.S. Pat. No. 4,656,850 Tabata, issued Apr. 14, 1987, a magnetic latching solenoid is utilized. Tabata teaches the functionings of a magnetic latching solenoid and its application in his electric lock. Tabata's use of a magnetic latching solenoid is theoretical. Tabata's electric lock does not address the real-life application problems referenced above with the use of this type of solenoid. Additionally, given the quantity of components required in Tabata's lock and the limited amount of free space available in any given existing lock, the mechanisms contained in Tabata's lock are not suitable for converting existing mechanical locks to operate electrically using momentary power.

The current invention overcomes the problems addressed above with a conversion apparatus (or as OEM equipment) operated by momentary power.

In the current invention, with the use of the apparatus, the locking and unlocking of the lock is provided by use of momentary power, in a way such that successful completion of the operation is achieved regardless of whether or not there is pressure being placed on the lock's knob or lever by the person seeking access. Additionally, the size and shape of the conversion apparatus makes the conversion to operation by momentary power possible for virtually any lock.

SUMMARY OF THE INVENTION

The object of the present invention is to eliminate the problems experienced by the existing systems and dramatically extend the battery life. In the preferred embodiment, a magnetic latching solenoid is employed, rather than a pull or push type of solenoid. The connection between the locking pin and the plunger of the solenoid allows free operation of the solenoid, even though the locking pin might be bound either by pressure placed on the knob or lever, or if the knob or lever has been turned previously and is not ready to accept the locking pin. With this mechanism, once the lock unit is ready to change its status, it will go into the required mode without requiring additional electric power.

These and other objects' advantages and features of the invention will be apparent from the following description of preferred embodiments considered along with the accompanying drawings.

DESCRIPTION OF PREFERRED EMBODIMENTS

Figure 1:
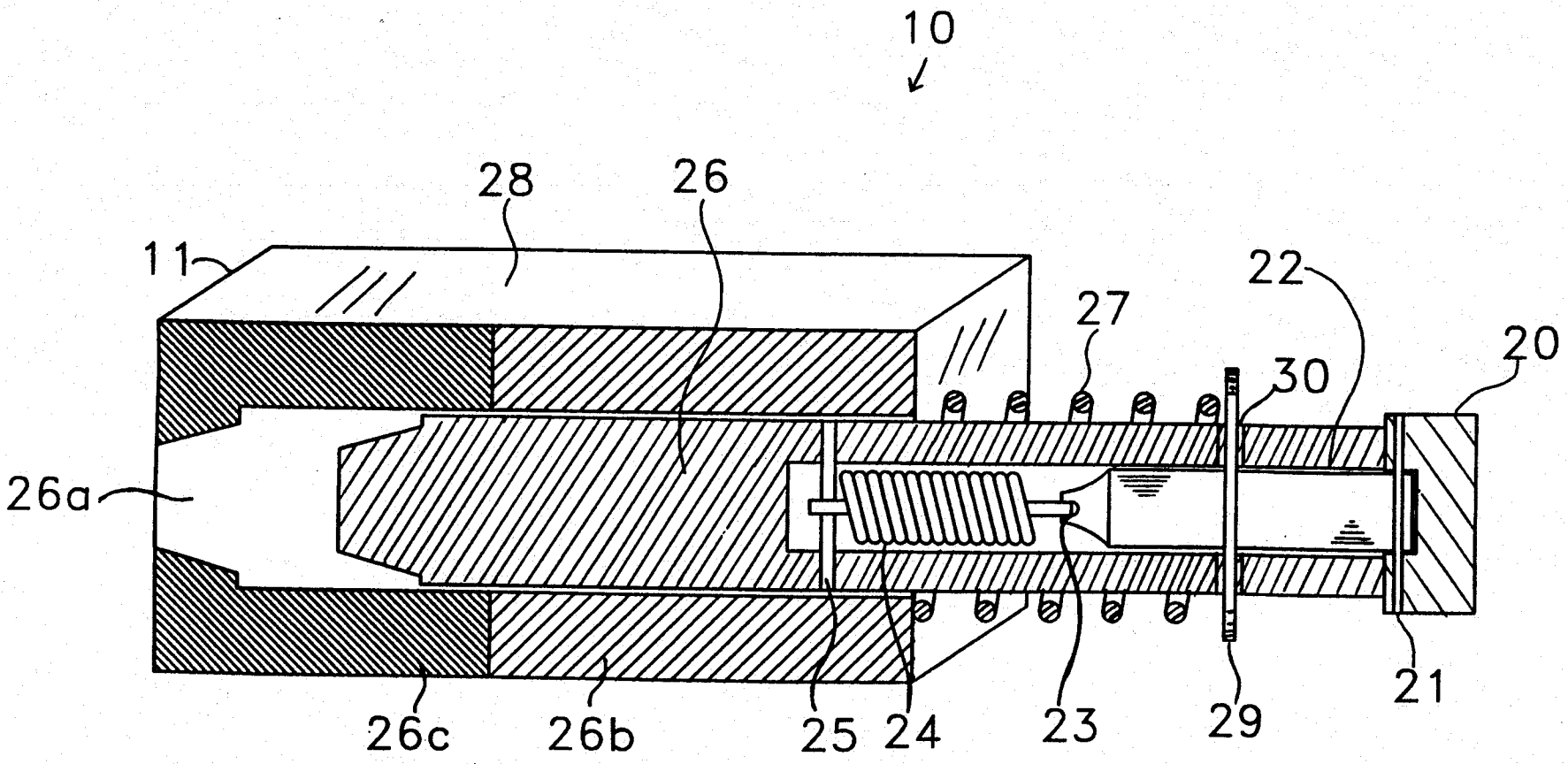
FIG. 1 is a view of a conversion apparatus of the invention with rectangular body.

In the drawings, FIG. 1 shows the apparatus 10 of the invention with a rectangular body. In the present invention, the normal pull or push type solenoid is replaced by the conversion apparatus 10, a magnetic latching solenoid with a special plunger mechanism. The apparatus consists of a rectangular-bodied magnetic latching solenoid 11 with an integrated piston and plunger shaft 26, replacing the regular plunger unit. The piston and plunger shaft are connected by an inner spring or second spring 24. The piston consists of a locking pin 20 connected to the piston shaft 22 by connector pin 21, and the plunger shaft unit 26 consists of a bored plunger capable of receiving the piston shaft 22, as shown. The plunger shaft 26 also has a circumferential groove 30 to hold a retainer ring 29 for an outer spring or first spring 27. The plunger shaft 26 and piston are connected together by the inner spring or second spring 24 at spring connection points 23 and 25. As indicated, the plunger shaft 26 is slidable in and out of a solenoid cavity 26*a*, which is surrounded by a permanent magnet 26*b* and an electromagnet 26*c* indicated schematically in the drawing.

Figure 2:
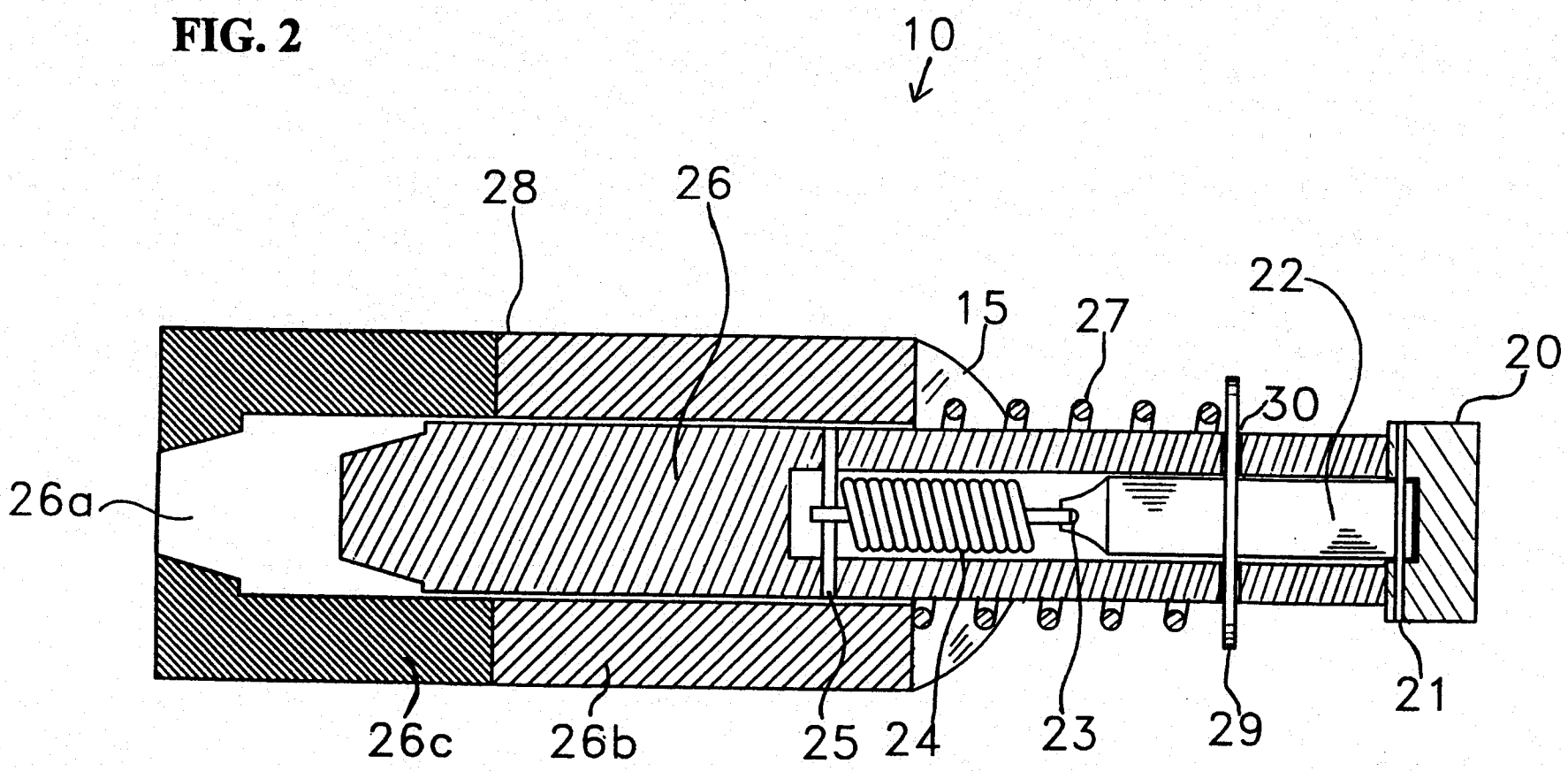
FIG. 2 is a view of the conversion apparatus with tubular body.

FIG. 2 shows the same conversion apparatus with a tubular body 15. There is virtually no difference, except for the body shape of the solenoid. This allows use in cylindrical locks.

Figure 3C:
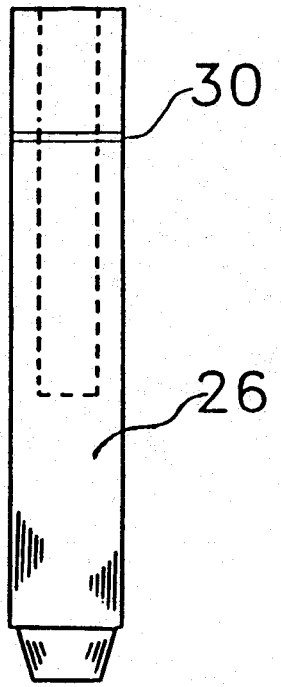
FIGS. 3A, 3B and 3C are detailed views of the shaft and locking pin of the conversion apparatus.
Figure 3B:
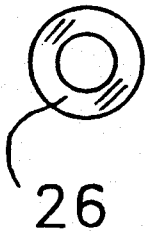
Figure 3A:
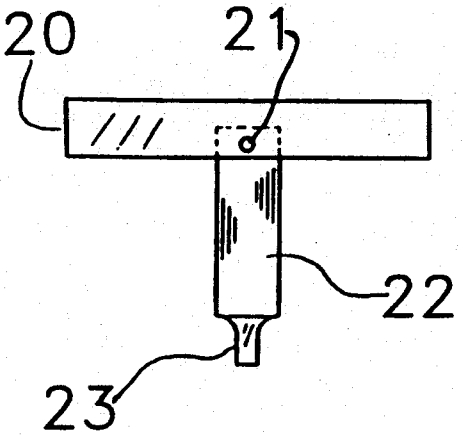

FIGS. 3A–3C show in detail the integrated piston and plunger shaft of the conversion apparatus, separated from each other. FIG. 3B is an end view of the plunger shown in FIG. 3C.

Figure 4:
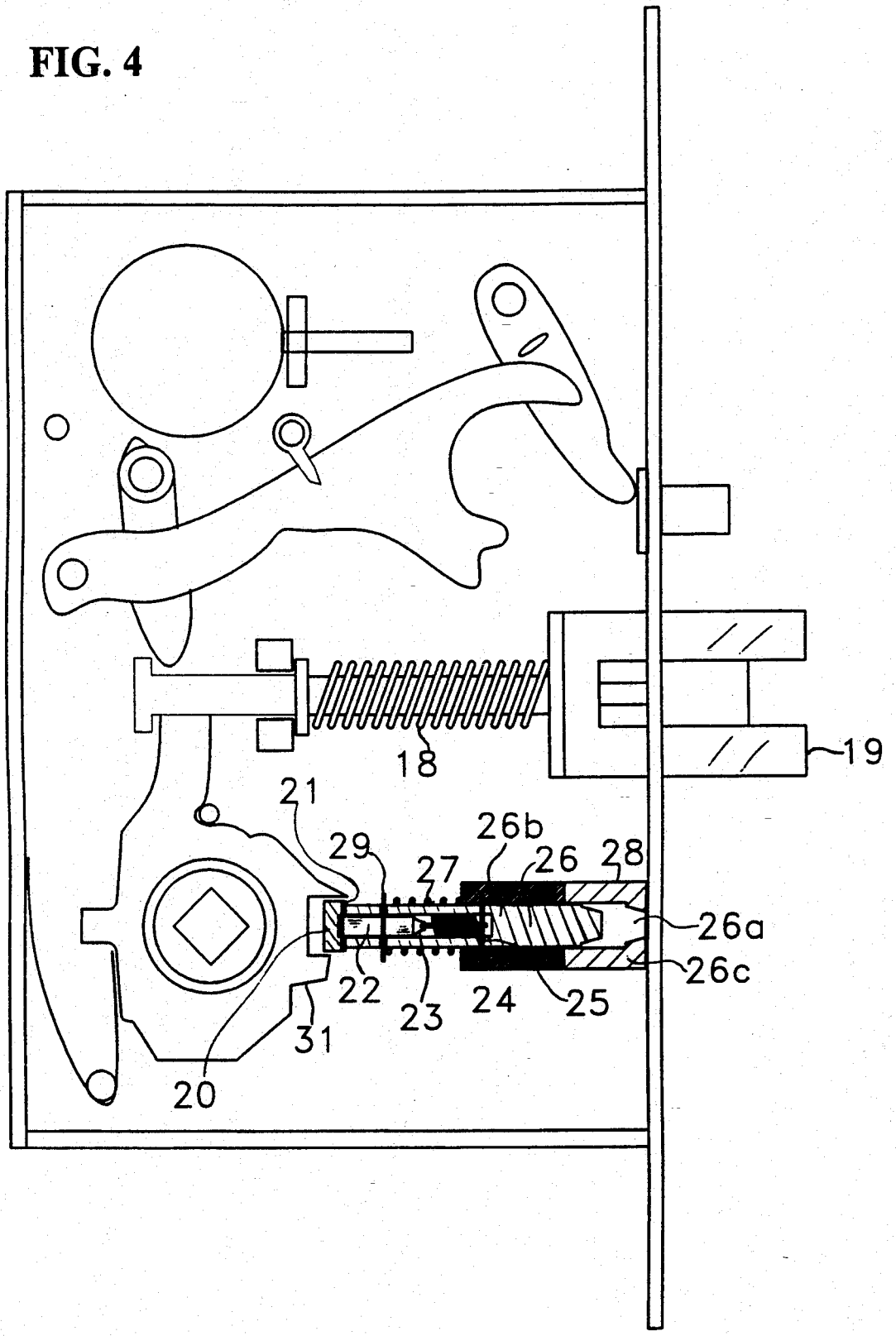
FIG. 4 is a view of a locking mechanism incorporating the conversion apparatus of the invention for mortise type locks.

FIG. 4 is a view of the conversion apparatus with a rectangular body fitted to a mortise type lock. The magnetic latching solenoid 10 operates by applying momentary power at different polarities. The solenoid contains both a permanent magnet and a coil capable of creating an electromagnet, as indicated in FIG. 1. The direction of the electromagnet is changed by polarity. When momentary power is applied in the first polarity position, it neutralizes the permanent magnet by creating an electromagnet of equal value in the reverse direction inside the unit. The plunger shaft 26 is then pushed out by the outer spring or first spring 27 (see also FIG. 1). When the power polarity is reversed, an electromagnet parallel to the permanent magnet is created inside the unit, which doubles the magnetic power, and the power created is greater than the power of outer spring or first spring 27, thereby pulling in the plunger shaft of the solenoid 26. In the current invention, the plunger unit is modified so that free movement of the locking pin for locking and unlocking purposes is established, even though the movable internal component or reactionary hub 31 of the lock assembly might be putting pressure on the locking pin 20.

To unlock, the solenoid 28 is powered in its second polarity position, where an electromagnet in parallel polarity to the permanent magnet is produced, thus creating a pulling power greater than the pushing power of the outer spring or first spring 27, thereby pulling in the plunger shaft 26. If the locking pin 20 is binding due to the pressure placed upon the movable internal component or reactionary hub 31, the plunger shaft 26 is still able to pull in, against the light spring tension of the inner spring or second spring 24, which is attached to the inside shaft 22 by the pins 23 and 25 and which thereby expands. Upon release of pressure on the locking pin 20 by the movable internal component or reactionary hub 31, the inner spring or second spring 24 pulls the locking head and the inside shaft, thereby unlocking the movable internal component or reactionary hub 31. At this point, the hub can turn freely to pull in the lock's latch mechanism 19.

To lock, the solenoid 28 is powered in its first polarity position, where an electromagnet in opposite polarity to the permanent magnet inside the solenoid 28 is created, thereby neutralizing the magnets inside, allowing the plunger shaft 26 to be pushed out by the outer spring or first spring 27. The pushing power of the outer spring or first spring 27 is less than the pulling power of the permanent magnet when the plunger shaft 26 is inside the solenoid 28. However, once the permanent magnet is neutralized and the plunger shaft 26 is pulled out of the solenoid 28, the permanent magnet is not able to pull the plunger shaft 26 back in, even though it is no longer neutralized. The permanent magnet has a weaker effect due to its distance from the plunger, and is unable to overcome the outer spring or first spring 27. This "over center" or "dumping" effect occurs even before the plunger reaches the position where the locking pin engages in the recess of the movable internal component or reactionary hub 31. In a preferred embodiment, the distance to reach "over center" is about ⅛ inch or less and is governed by the strength of the outer spring or first spring 27 and by the positioning and strength of the permanent magnet 26*b*. If the movable internal component or reactionary hub 31 is turned and not ready to accept the locking pin 20, the power of outer spring or first spring 27 pushes the locking pin 20 against the movable internal component or reactionary hub 31 and maintains it there without continued activation of the electromagnet, until the hub is turned back to its lockable position. Then the plunger shaft 26 powered by the outer spring or first spring 27, enters into the movable internal component or reactionary hub 31 and prevents further turning, thereby locking it. The locking pin 20 is attached to the inside shaft 22 with the connector pin 21 as described above, allowing movement of the locking pin 20 from the inside shaft or piston shaft 22. This avoids binding of the inside shaft 22 and the plunger shaft 26 together in the case of pressure being applied to the locking pin 20 by the movable internal component or reactionary hub 31.

When the locking pin 20 enters the movable internal component or reactionary hub 31, it blocks the movement of the movable internal component or reactionary hub 31 against the lock case body because the locking pin 20 slides on a track located on the lock case body.

To ensure smooth operation, the locking pin 20, connector pin 21 and inside shaft 22 are made from stainless steel, and outer spring or first spring 27 and inner spring or second spring 24 are made of bronze. This is because these materials are not affected by magnetic power. Other suitable non-magnetic material may be used.

Figure 5:
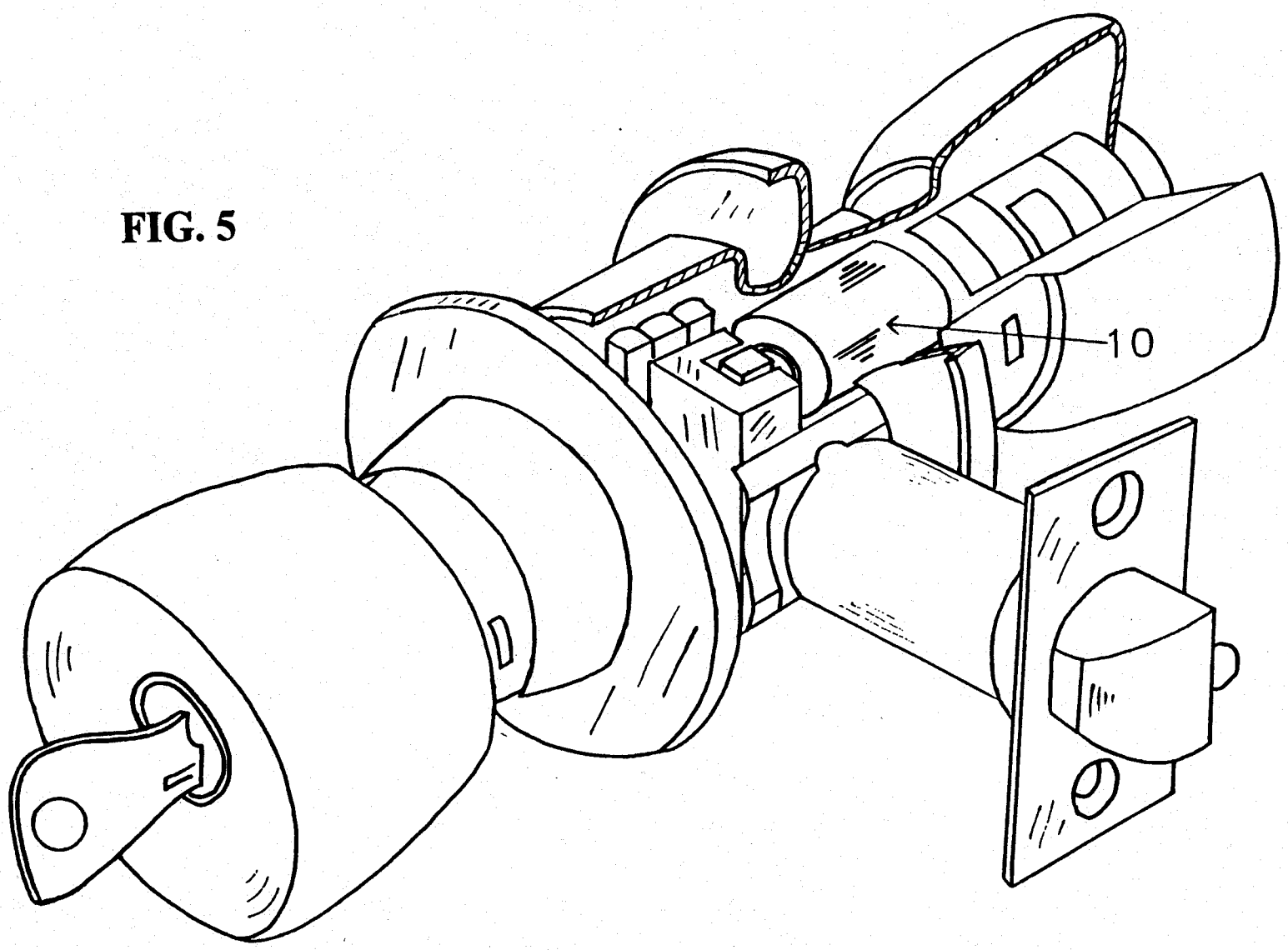
FIG. 5 is a view of a locking mechanism incorporating the conversion apparatus of the invention for tubular type locks.

FIG. 5 shows the same conversion apparatus applied to a tubular lock (commonly known as a "knoblock"). The operation is virtually the same as described for FIG. 4.

Figure 6:
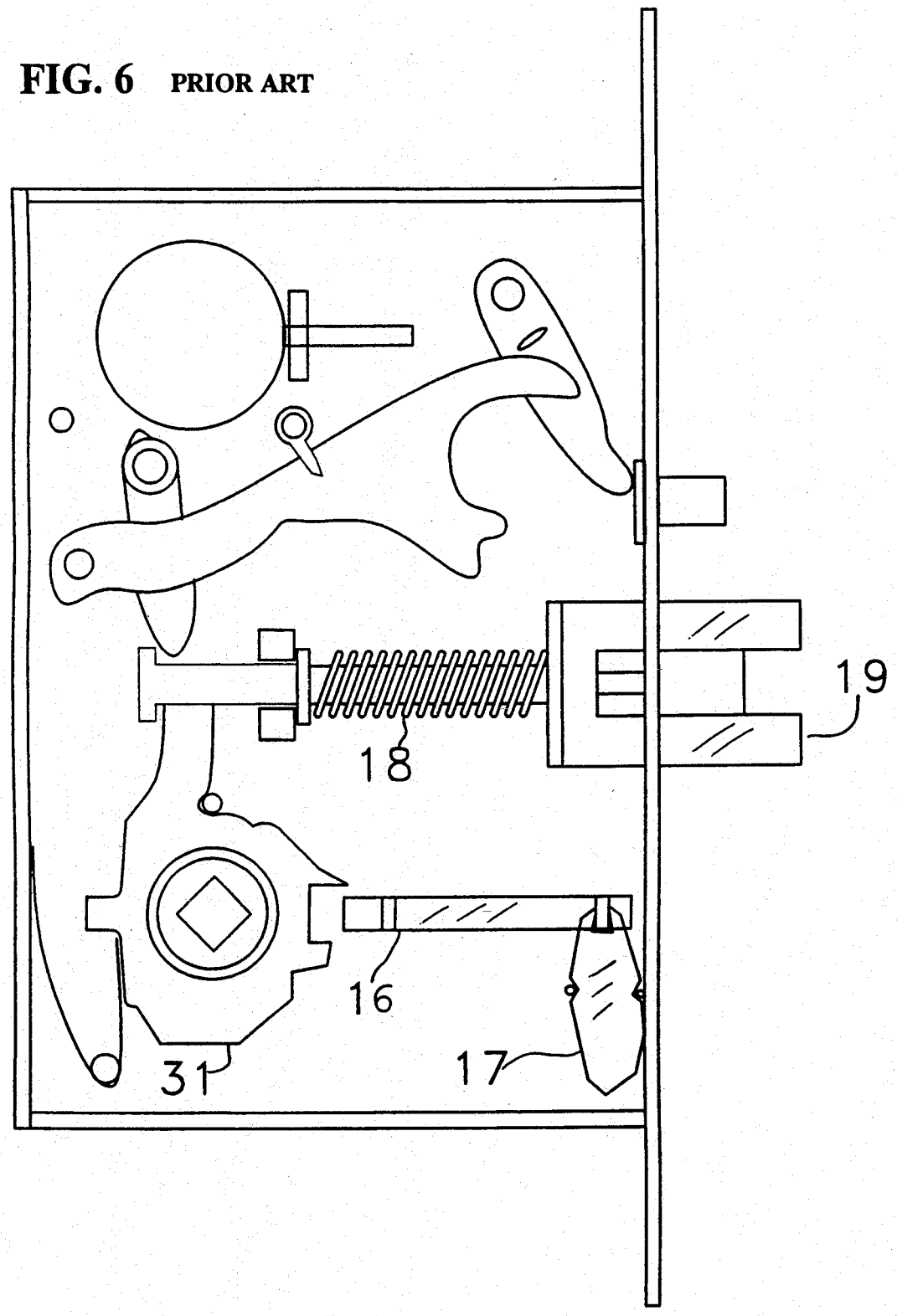
FIG. 6 PRIOR ART
FIG. 6 is a view showing a mechanical locking/unlocking principle applied to a mortise type lock in accordance with the prior art. A manual pressing of the toggle action switch is required to change the status from locked to unlocked, and from unlocked to locked.

FIG. 6 shows the locking principle for a prior art mechanical (not electrified) mortise type lock. Pressing the toggle switch moves the locking bar 15 in and out of the movable internal component or reactionary hub 31, thereby accomplishing the locking and unlocking operations. Since the toggle action switch is located at the edge of the lock, the door must be opened before the toggle action switch 17 can be pressed. The door being opened eliminates any pressure that might be placed on the knob or lever by the person trying to enter in anticipation of the door's actual release. In addition, the human power that can be applied onto the toggle switch and the locking bar is much greater than the power provided by a solenoid.

Figure 7:
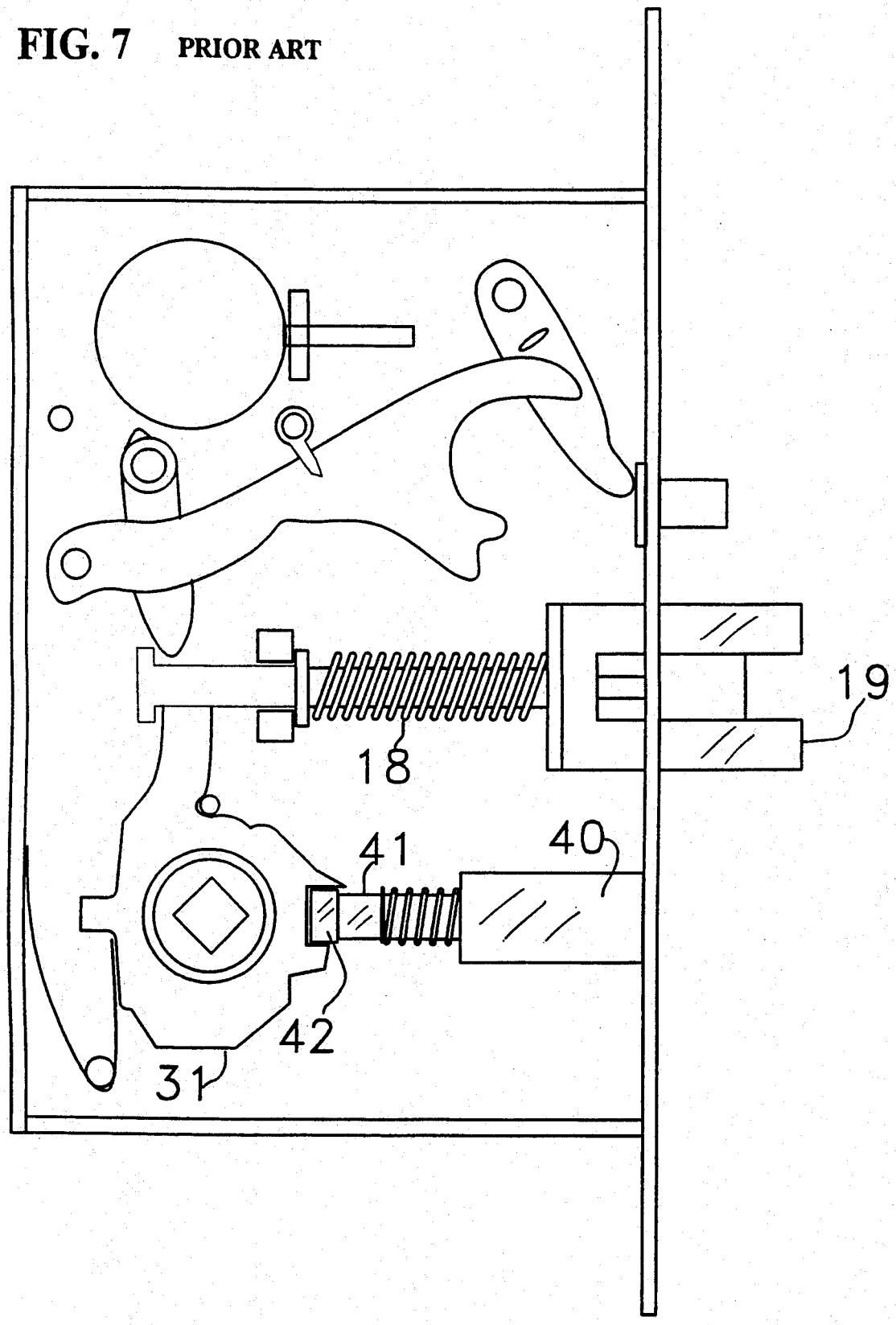
FIG. 7 PRIOR ART
FIG. 7 is a view of an electrified mortise lock using push or pull type solenoid, in accordance with the prior art.

FIG. 7 shows the toggle action switch 17 and locking bar 15 replaced by a conventional pull or push type solenoid, as in the prior art. When powered, or when the power is interrupted on the solenoid 40, the plunger 41 is pushed out by help of a spring, or pulled in by the created electromagnetic power to lock into or unlock out of the movable internal component or reactionary hub 31. Locking head 42, suitable for movable internal component or reactionary hub 31, is attached to the plunger 41. If pressure is placed upon the movable internal component or reactionary hub 31 by a knob or lever attached to the movable internal component or reactionary hub 31 through its plunger hole 10, the locking head 42 will be bound and locked in, even though it is being powered for unlocking. This is because the human power placed on the movable internal component or movable internal component or reactionary hub 31 binding the locking head is much greater than the pulling power established by the solenoid 40.

We claim:

1. A latching solenoid for use in a lock mechanism having a moveable internal component which is manipulated by persons seeking access, the moveable internal component having a recess or notch for receiving a locking bar or locking pin, comprising:

a solenoid housing having an internal solenoid cavity, a solenoid plunger fitted slidably within the solenoid cavity, first spring means for biasing the solenoid plunger toward a position out of the solenoid cavity, the solenoid plunger having a locking pin at its outer end, with means retaining the locking pin to the plunger so as to allow free movement of the locking pin outwardly away from but remaining in alignment with the plunger, and with second spring means biasing the locking pin toward a retracted, normal position adjacent to the end of the plunger, the locking pin being configured so as to fit within the recess of the moveable internal component of the locking mechanism, in the position a locking bar would assume, for locking of the lock mechanism, the solenoid housing including both a permanent magnet positioned to pull the plunger into the solenoid cavity to an unlocking position and an electromagnet reversible in polarity so as to either supplement the influence of the permanent magnet to pull the plunger into the solenoid cavity or, in a reversed polarity, to counteract the influence of the permanent magnet to the extent that the first spring means is able to push the plunger to a locking position wherein the plunger extends out of the solenoid cavity, whereby, when the plunger and locking pin are in the locked position with the pin in the recess or notch but are to be moved to the unlocked position to admit a person seeking access, and the person moves and puts pressure on the moveable internal component of the lock mechanism prematurely so as to bind the locking pin in place via the recess or notch while the plunger seeks to be retracted, a brief pulse of power to the electromagnet will retract the plunger independently of the locking pin, against the forces of the first spring means and the second spring means, and the locking pin will subsequently be pulled back by the force of the second spring means to return to its position against the end of the plunger after the person releases pressure on the moveable internal component, thus enabling the lock mechanism to be unlocked by only a pulse of power to the electromagnet.

2. The latching solenoid of claim 1, wherein the first spring means is of such strength relative to the permanent magnet's strength and position relative to the plunger, that the plunger is "over center" or "dumped" beyond the ability of the permanent magnet to retract it into the solenoid cavity, at a point at which the plunger has only extended short distance in its travel out of the solenoid cavity, a sufficiently short distance that the "over center" or "dumped" position is reached before the locking pin reaches the recess or notch of the moveable internal component, whereby, when the moveable internal component is shifted in position by a person seeking access while the lock mechanism is unlocked and the locking pin and plunger are in the retracted position toward the solenoid cavity, the plunger and locking pin can be extended outwardly by the first spring means and a pulse of the electromagnet at the appropriate polarity, to the extent that the plunger reaches the "dumped" position beyond the influence of the permanent magnet and bears against the moveable internal component, without the locking pin entering into the recess, so that the locking pin will remain in such position until it is able to settle into the recess of the moveable internal component at such time as the moveable internal component is returned to a normal position, thus requiring only a pulse of power to the electromagnet to lock the lock mechanism.

3. The latching solenoid of claim 1, wherein the means retaining the locking pin to the plunger comprises the plunger having a bore extending axially inwardly from its outer end, and the locking pin having a piston or shaft extending into the bore of the plunger for sliding movement of the locking pin relative to the plunger.

4. The latching solenoid of claim 3, wherein the locking pin includes swivel mounting means securing the locking pin to the piston or shaft, for permitting swiveling or rocking action of the locking pin relative to the piston or shaft and relative to the plunger, so that force exerted by a user on the moveable internal component, tending to bind the locking pin in position against retraction, will not bind the piston or shaft in the plunger bore so as to prevent the free retraction of the plunger from the locking pin.

5. The latching solenoid of claim 3, wherein the second spring means comprises a tension spring positioned inside the plunger bore and secured to the plunger and the shaft or piston so as to exert a force pulling the locking pin toward the plunger.

6. The latching solenoid of claim 1, wherein the second spring means is a lighter spring than the first spring means, such as to allow the plunger to be retracted against the forces of both spring means by the permanent and electromagnets in the condition wherein the locking pin is bound in place by the person's prematurely moving the moveable internal component.

7. The latching solenoid of claim 1, wherein the electromagnet is of such strength and position so as to substantially balance the force of the permanent magnet when the plunger is in a position fully retracted into the solenoid cavity.

8. The latching solenoid of claim 1, wherein the moveable internal component of the lock mechanism comprises a rotational reactionary hub, having said recess or notch.

9. A lock mechanism incorporating the latching solenoid of claim 8.

10. A lock mechanism incorporating the latching solenoid of claim 1.

* * * * *